United States Patent [19]

Hutchens

[11] 4,219,137

[45] Aug. 26, 1980

[54] EXTENDABLE SPOUT FOR A CONTAINER

[76] Inventor: Morris L. Hutchens, 16960 Ridgeview Dr., Brookfield, Wis. 53005

[21] Appl. No.: 4,157

[22] Filed: Jan. 17, 1979

[51] Int. Cl.[2] ..... B65D 37/00; B65D 39/12

[52] U.S. Cl. ..... 222/462; 222/530

[58] Field of Search ..... 222/527, 528, 529, 530, 222/386.5, 462

[56] References Cited

U.S. PATENT DOCUMENTS

| | | | |
|---|---|---|---|
| 2,430,905 | 11/1947 | Bradley . | |
| 2,565,699 | 8/1951 | Rieke . | |
| 2,661,128 | 12/1953 | Rieke . | |
| 2,725,087 | 11/1955 | Potter . | |
| 2,899,110 | 8/1959 | Parker . | |
| 3,204,827 | 9/1965 | Krautkramer | 222/530 X |
| 3,613,966 | 10/1971 | Summers . | |
| 4,082,827 | 4/1978 | Chlystrum | 222/529 X |

FOREIGN PATENT DOCUMENTS

| | | | |
|---|---|---|---|
| 597769 | 5/1960 | Canada | 222/530 |

*Primary Examiner*—David A. Scherbel
*Attorney, Agent, or Firm*—Cyril M. Hajewski

[57] ABSTRACT

An extendable spout for a container formed of blown plastic in which the top of the container is formed of convoluted plastic which may be nested into the container. This eliminates the protruding spout when the container is being shipped to save the space but the spout may be extended from the container by expanding the convolutions to form a convenient pouring spout or funnel. The bottom of the container is likewise formed of convoluted plastic and the convolutions expand for extending the bottom into the container to compensate for the volume added to the container by the spout when the latter is extended.

5 Claims, 3 Drawing Figures

FIG. 1
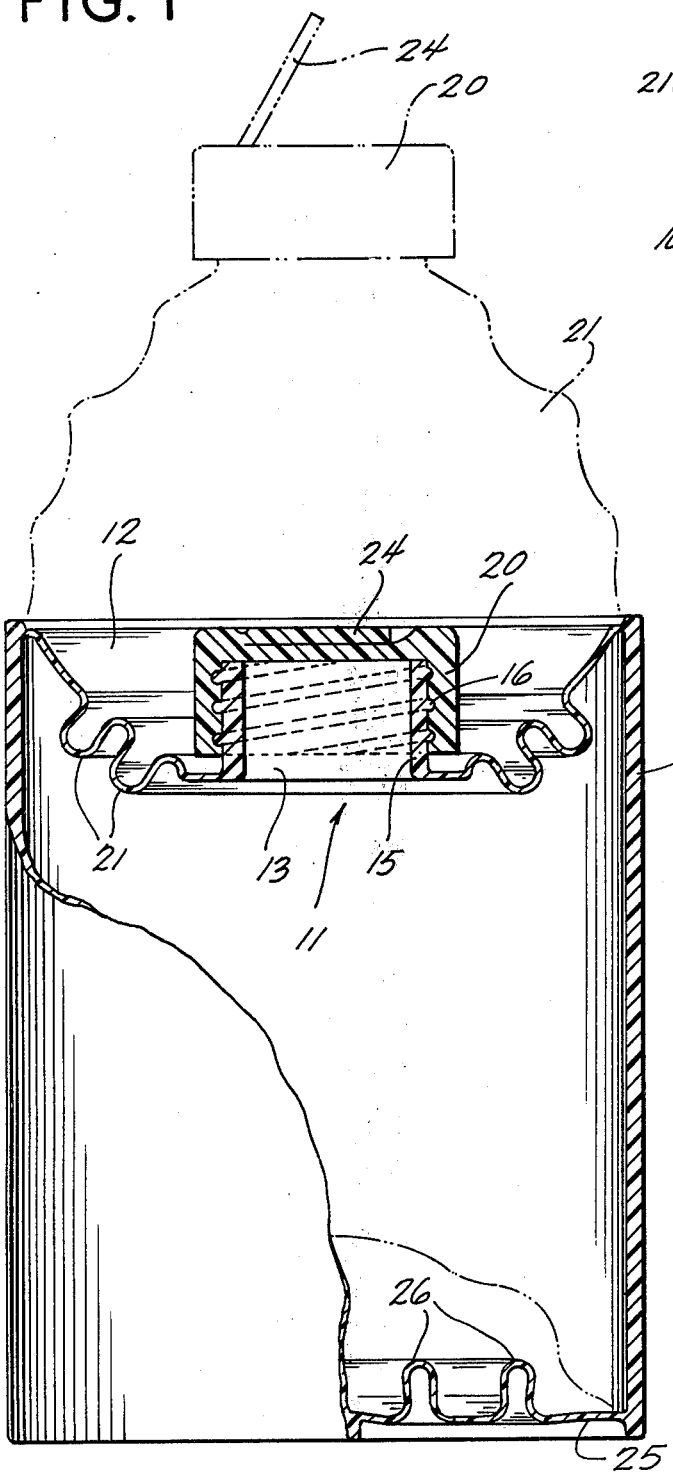
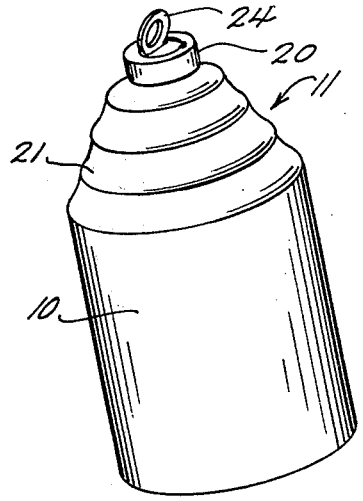
FIG. 2
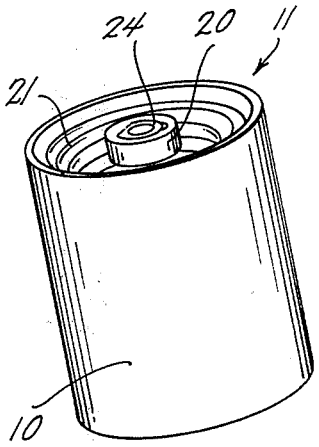
FIG. 3

EXTENDABLE SPOUT FOR A CONTAINER

BACKGROUND OF THE INVENTION

Liquid containers present a problem insofar as it is difficult to accurately pour the liquid out of the container into a restricted opening unless the container is provided with a spout. However, the spout consumes an appreciable amount of space which increases the cost of shipping.

For example, automobile lubricating oil is usually solid in cylindrical containers for economical transportation. However, it is impractical to pour the oil from the can in which it is sold directly into the crankcase filler pipe of the automobile without the assistance of some other appliance. This is usually a spout having a piercer on one end for piercing the lid of the can. Such spouts are inconvenient to use because the oil is very apt to escape at the juncture of the spout with the can and the spout itself becomes covered with oil and messy to handle. The other alternative is to use a funnel.

Efforts have been made in the past to alleviate this situation but such efforts have not been entirely successful. For example in U.S. Pat. No. 2,565,699 the inventor provided a telescopic spout that is inserted in the container until ready for use. It is then extended to facilitate pouring the liquid out of the container. The telescopic spout provided in this structure is relatively expensive to manufacture and it extends from a very small circular portion of the lid of the can so that its length is restricted. This characteristic renders it somewhat limited in its capabilities to direct liquid into an opening located in cramped quarters such as the opening of an automobile crankcase filler tube.

Another effort is disclosed in U.S. Pat. No. 3,613,966 which shows a telescopic spout which is nested in the container until it is ready for use. Such arrangement is likewise relatively expensive to manufacture and the spout must necessarily be limited in size because of its structural arrangement in the container.

The present invention overcomes these disadvantages by molding the entire container of a unitary blown plastic and forming the spout portion of a convoluted surface which can be nested into the interior of the container for shipping purposes. However when the liquid is to be poured out of the container this convoluted spout portion can be readily extended from the container into a generally conical configuration. The base of the cone is of substantially the same diameter as the container so that the spout serves as a funnel that will be of maximum size and length for the greatest convenience in pouring the liquid out of the container.

It is therefore a general object of the present invention to provide an improved extendable spout or funnel for a container which spout is retracted into the container for economy in shipping and is extended into operating position when ready for use.

It is a further object of the invention to provide an improved extendable spout for a liquid container which is relatively inexpensive to manufacture but efficient in operation.

SUMMARY OF THE INVENTION

The invention comprises a container formed of blown plastic and having a cap connected to the body of the container by a convoluted portion which nests into the body of the container for shipping purposes. When the contents are to be poured out of the container the cap and its cooperating convoluted portion are pulled out of the body to form a spout which extends outwardly therefrom with the convoluted portion taking the general shape of a cone and the cap being at the top of the cone so that it acts as a funnel.

The extension of the spout out of the body of the container creates a greater volume at the top of the container which must be compensated for in order to avoid creating the vacuum which would resist extending the spout out of the container. To this end, the bottom of the body of the container is also formed of convoluted material which will expand inwardly into the interior of the container to take up the extra volume produced by the extension of the spout portion.

DESCRIPTION OF THE DRAWING

FIG. 1 is an elevational view of the improved pouring spout of the present invention formed in a container with a portion of the container being broken away to reveal the convoluted portions nested within the container;

FIG. 2 is a perspective view of the container shown in FIG. 1 with the improved spout of the present invention extended to facilitate pouring of the contents out of the container; and FIG. 3 is a perspective view of the container shown in FIG. 1 with the spout retracted into the body of the container for shipping purposes.

DETAILED DESCRIPTION

Reference is now made more particularly to the drawings and specifically to FIG. 1 thereof which illustrates a container equipped with the improved extendable spout or funnel of the present invention. The container comprises a cylindrical body portion 10 which is provided with the improved extendable spout of the present invention generally identified by the reference numeral 11.

The spout 11 is illustrated in solid lines in FIG. 1 in its retracted position, nested within the body 10, so that it will occupy a minimum amount of space while it is being shipped. However, to facilitate pouring the contents of the container out of the body 10, the spout 11 is extendable to the position shown by the broken lines in FIG. 1.

The spout 11 includes a circular sheet of flexible material 12 with a central concentric opening 13. The outer diameter of the circular sheet 12 is secured to the body 10 and its inner diameter is attached to a neck or mouth 15. The neck 15 is provided with threads 16 for meshing with complementary threads formed on the interior of a cap 20 which is screwed down onto the neck 15 for sealing the container.

The circular sheet 12 is provided with a plurality of annular convolutions 21 which are compressed together to enable the spout 11 to be nested within the confines of the body 10 as illustrated in solid lines in FIG. 1 and also in the perspective view of FIG. 3. However, since the circuit sheet 12 is formed of a flexible material, the convolutions 21 may be deformed by drawing the entire spout 11 out of the body 10 to the position illustrated by the broken lines in FIG. 1 and also shown in the perspective view of FIG. 2. When the spout 11 is thus extended, the circular sheet 12 assumes the generally conical configuration shown in the drawing to form an attached funnel which facilitates pouring the contents out of the container through the neck 15. The convolutions 12 are so constructed that when they are deformed by expanding them to the position shown by the broken lines in FIG. 1 they will lock in the expanded position so that it would be necessary to force the spout back to the retracted position.

For convenience in extending the spout 11 the cap 20 is provided with a finger loop 24 that normally rests upon the top of the cap 20. However, only one side of the finger loop 24 is attached to the cap 20 so that it may be pivoted upwardly from the position shown in solid lines in FIG. 1 to the position shown by the broken lines to enable the person to grasp the finger loop 24 and pull on it to deform the convolutions 12 for extending the spout 11 out of the body 10.

When the spout 11 is extended from its retracted position to the extended position shown by the broken lines in FIG. 1, a substantial amount of additional volume is created within the spout 11 above the body 10. In order to compensate for this additional volume at the top of the container, the bottom 25 of the body 10 is likewise formed of a circular sheet of material having a plurality of annular convolutions 26 which are normally compressed together as shown by the solid lines in FIG. 1 to form a relatively flat bottom. However, when the spout 11 is extended, the creation of a vacuum within the body 10 is avoided by the convoluted bottom 25 which will extend upwardly by expanding its convolutions 26 to the position shown by the broken line in FIG. 1. Thus, the upward movement of the bottom 25 into the body 10 compensates for the additional volume at the top of the container above the body 10 caused by the extension of the spout 11. The convolutions 26 are constructed so that the bottom 25 will return to its normal position as shown by the solid lines in FIG. 1 when the vacuum is removed from the interior of the container. Thus, when the cap 20 is removed the bottom 20 will automatically return from the position shown by the broken lines in FIG. 1 to the position depicted by the solid lines.

The entire container with the exception of the cap 20 but including the body 10. the spout 11 and the bottom 25 may be formed of a blown plastic so that the complete assembly comprises a unitary structure which may be manufactured very rapidly and inexpensively.

From the foregoing detailed description of the illustrative embodiment of the invention set forth herein it will be apparent that there has been provided an improved extendable pouring spout or funnel for a container which may be manufactured as a unitary structure with the container itself to enable it to be manufactured inexpensively but which operates with the utmost efficiency. The spout may be retracted so that the container is in the form of a cylinder, without any protrusions, to conserve shipping space, but which may be extended to form a spout from which the contents of the container can be readily poured.

Although the illustrative embodiment of the invention has been described in considerable detail for the purpose of disclosing a practical, operative arrangement by means of which the invention may be practised advantageously, it is to be understood that the particular apparatus illustrated and described is intended to be illustrative only and that the various novel characteristics of the invention may be incorporated in other structural forms and methods without departing from the spirit and scope of the invention as defined in the subjoined claims.

The principles of this invention having now been fully explained in connection with the foregoing description, I hereby claim as my invention:

1. An extendable spout forming the entire top of a container having a body portion which contains the contents of the container; a neck opening into the container; and a sheet joined to the top of said body at its periphery and to said neck to seal the neck to said body; a plurality of annular convolutions formed in said sheet concentric with said neck so that said convolutions may be compressed to retract said sheet and said neck forming the entire top of the container into said body, and said convolutions may be expanded to permit extending of said sheet and said neck out of said body to form a funnel attached to said body that serves as a spout which facilitates pouring the contents out of said container.

2. An extendable spout according to claim 1 wherein said neck is provided with a removable cap for sealing the containers, said cap having a recess in its top; means for securing said cap to said neck; and a pull disposed within the recess of said cap and pivotally attached thereto so that it may be pivoted out of said recess to enable a person to secure the pull with a finger for withdrawing the neck and its associated sheet from said body portion.

3. An extendable spout according to claim 1 wherein said body is of cylindrical configuration and said sheet is of annular configuration with its outer diameter joined to said body and its inner diameter joined to said neck, and each of said convolutions follows an annular path which is concentric with said neck and with said cylindrical body.

4. An extendable spout according to claims 1, 2 or 3 including a flexible circular bottom on said body portion; and a plurality of convolutions formed in said bottom, each of said convolutions following an annular path which is concentric with said body, said convolutions being compressed to extend said bottom straight across said body, but said convolutions being expandable to permit said bottom to move into the interior of the container in a generally conical shape to compensate for the increased volume at the top of the container when said spout is extended out of said body.

5. An extendable spout forming part of a container having a pody portion; a neck opening into the container; a sheet joined to said body and to said neck to seal the neck to said body; convolutions formed in said sheet so that said convolutions may be compressed to permit retraction of said neck into said body, and said convolutions may be expanded to permit extending of said sheet and said neck out of said body so that said sheet and said neck cooperate to serve as a spout which facilitates pouring the contents out of said container; a flexible circular bottom on said body portion; and a plurality of convolutions formed in said bottom, each of said convolutions following an annular path which is concentric with said body, said convolutions being compressed to extend said bottom straight across said body, but said convolutions being expandable to permit said bottom to move into the interior of the container in a generally conical shape to compensate for the increased volume at the top of the container when said spout is extended out of said body.

* * * * *